US006076490A

United States Patent [19]

Esch et al.

[11] Patent Number: 6,076,490

[45] Date of Patent: Jun. 20, 2000

[54] ELECTROMAGNETIC ASSEMBLY WITH GAS SPRINGS FOR OPERATING A CYLINDER VALVE OF AN INTERNAL-COMBUSTION ENGINE

[75] Inventors: Thomas Esch, Aachen; Michael Schebitz, Eschweiler; Martin Pischinger, Aachen, all of Germany

[73] Assignee: FEV Motorentechnik GmbH & Co.KG, Aachen, Germany

[21] Appl. No.: 09/123,987

[22] Filed: Jul. 29, 1998

[30] Foreign Application Priority Data

Jul. 31, 1997 [DE] Germany ..... 197 33 186

[51] Int. Cl.[7] ..... F01L 9/04

[52] U.S. Cl. ..... 123/90.11; 123/90.65; 251/129.1; 251/129.15; 251/129.18

[58] Field of Search ..... 123/90.11, 90.14, 123/90.65; 251/129.01, 129.02, 129.1, 129.15, 129.16, 129.18

[56] References Cited

U.S. PATENT DOCUMENTS

| | | | |
|---|---|---|---|
| 4,455,543 | 6/1984 | Pischinger et al. | 335/266 |
| 4,831,973 | 5/1989 | Richeson, Jr. | 123/90.11 |
| 4,883,025 | 11/1989 | Richeson, Jr. | 123/90.11 |
| 5,022,358 | 6/1991 | Richeson | 123/90.12 |
| 5,199,392 | 4/1993 | Kreuter et al. | 123/90.11 |
| 5,233,950 | 8/1993 | Umemoto et al. | 123/90.14 |
| 5,611,303 | 3/1997 | Izuo | 123/90.11 |
| 5,664,527 | 9/1997 | Boudy | 123/90.14 |
| 5,832,955 | 11/1998 | Schrey | 137/551 |

*Primary Examiner*—Wellun Lo
*Attorney, Agent, or Firm*—Venable; Gabor J. Kelemen

[57] ABSTRACT

A combination of a cylinder valve of an internal-combustion engine with an electromagnetic assembly for operating the valve. The electromagnetic assembly includes an electromagnetic actuator having first and second electromagnets supported in a spaced relationship with respect to one another, an armature movable between the first and second electromagnets and connected to the valve for moving it between open and closed positions. The electromagnetic assembly further includes a first control device for energizing the electromagnets to cause a motion of the valve by electromagnetic forces generated by the first and second electromagnets; and first and second pressurizable resetting gas springs operatively coupled to the armature to oppose motions thereof caused by the electromagnetic forces generated by the first and second electromagnets, respectively. A pressure supply device supplies pressure to the first and second resetting gas springs. A second control device controls the pressure supplied to the first and second resetting gas springs.

4 Claims, 3 Drawing Sheets

ELECTROMAGNETIC ASSEMBLY WITH GAS SPRINGS FOR OPERATING A CYLINDER VALVE OF AN INTERNAL-COMBUSTION ENGINE

CROSS REFERENCE TO RELATED APPLICATION

This application claims the priority of German Application No. 197 33 186.6 filed Jul. 31, 1997, which is incorporated herein by reference.

BACKGROUND OF THE INVENTION

In piston-type internal-combustion engines the cylinder valves have been controlled until recently by a cam shaft of the engine with the intermediary of a linkage system mechanically coupling the cam shaft with the cylinder valve. As an alternative to such a valve control, in more recent engine designs electromagnetic actuators have been used for operating the cylinder valves. Such an electromagnetic actuator includes two spaced electromagnets between which an armature reciprocates in response to electromagnetic forces generated as a function of the energizing currents controlled by an electronic control system of the engine. The armature, in response to electromagnetic forces, moves against the force of resetting springs and is coupled with the respective cylinder valve to effect corresponding motions thereof. Such a system is described, for example, in U.S. Pat. No. 4,455,543.

Heretofore mechanical springs such as coil springs have been used as resetting springs, which, in principle, have been found to be satisfactory.

Operating a cylinder valve with an electromagnetic actuator controlled by an electronic control system makes possible a freely variable valve control, that is, it is feasible to vary both the opening moment and the open period of the valve as a function of the load requirements of the engine. In the design of the electromagnetic actuator, however, the oscillation characteristics of the spring/mass system composed of the armature and the cylinder valve as the mass and the mechanical resetting springs as the spring element have to be considered as a fixed, given magnitude.

SUMMARY OF THE INVENTION

It is an object of the invention to provide an electromagnetic valve-operating assembly of the above-outlined type, whose adaptability to the operating conditions is further improved.

This object and others to become apparent as the specification progresses, are accomplished by the invention, according to which, briefly stated, the electromagnetic assembly for operating a cylinder valve of an internal-combustion engine includes an electromagnetic actuator having first and second electromagnets supported in a spaced relationship with respect to one another and an armature movable between the first and second electromagnets and connected to the valve for moving it between open and closed positions. The electromagnetic assembly further includes a first control device for energizing the electromagnets to cause a motion of the valve by electromagnetic forces generated by the first and second electromagnets; and first and second pressurizable resetting gas springs operatively coupled to the armature to oppose motions thereof caused by the electromagnetic forces generated by the first and second electromagnets, respectively. A pressure supply device supplies pressure to the first and second resetting gas springs. A second control device controls the pressure supplied to the first and second resetting gas springs.

The use of gas springs in which the gas pressure applied thereto and thus the spring constant is variable, is advantageous, because by varying the spring constant with the otherwise present engine control system, the spring constants and thus the oscillation characteristics of the oscillating system composed of the armature, the cylinder valve and the resetting gas springs may be adapted to the momentary load conditions. The resetting force and thus the oscillating characteristics may be adapted to the momentary operating conditions of the engine by suitably increasing or reducing the gas pressure applied to the gas spring, based on an initial, predetermined resetting force. An increase of the resetting force is, for example, expedient in a high-rpm operation to effect the high acceleration of the armature and the cylinder valve necessary to achieve short operating periods.

By positioning the resetting gas springs externally of the electromagnets, the external dimensions of the electromagnets, on the one hand, and the dimensions of the gas springs, on the other hand, may be optimally adapted to the existing requirements. As an eventual result, systems of narrow constructions may be built which can be accommodated in the limited space available above a cylinder of an internal-combustion engine. This advantage is of particular significance in engines in which each cylinder is provided with two intake valves and two exhaust valves.

According to the invention, one gas spring is connected with the cylinder valve and acts as a closing spring while the other gas spring is connected with the armature and acts as an opening spring. The armature, with its guide and the cylinder valve may form a closed, one-piece structural unit. It is, however, expedient to provide that the armature, together with its opening spring and the cylinder valve, together with its closing spring are movable independently from one another. By means of such a separation of the two structural components from one another, a wear compensation is feasible in the region of the valve seat and in the system itself by means of suitable automatic valve clearance (valve slack) adjusting devices. Such wear appears due to the different heat expansions in response to different temperatures particularly at the stem of the cylinder valve.

According to a particularly advantageous feature of the invention, the opening gas spring and the closing gas spring are arranged on the same side of the two electromagnets viewed as one assembly. This arrangement provides the possibility to manufacture the electromagnetic part, on the one hand, and the gas pressure-affected part, on the other hand, as a closed prefabricated unit which may be subsequently assembled to form the final aggregate.

While it is feasible in principle to use any system as a gas spring which makes possible a change of the gas pressure during operation (for example, a gas spring which operates similarly to a gas bubble storing device), according to a particularly advantageous feature of the invention, each gas spring is composed of a piston-and-cylinder unit. It is particularly expedient to guide the two gas springs (opening and closing springs) in a single, common cylinder.

According to another advantageous feature of the invention, the common cylinder accommodates two pistons which form part of the opening gas spring and the closing gas spring, and which are arranged at a distance from one another. The space defined between the two pistons may be separately pressurized in a controlled manner from a separate pressure source. By virtue of this arrangement, when the armature is held in the closed position by the electromagnetic actuator, an opening of the cylinder valve to execute a small stroke may be effected by pressurizing the intermediate space without energizing a magnet of the electromagnetic actuator. The sole condition to effect such an operation is to pressurize the intermediate space with a pressure medium, preferably a pressurized gas, with a pressure which is greater than that of the closing gas spring. By means of suitably controlling the magnitude and duration of the pressure, a desired partial opening stroke of the cylinder valve may be accordingly obtained.

The above-outlined construction permitting a partial opening of the cylinder valve makes possible an operation where, for example, the gas intake valve, during a suction cycle, is opened only for a short period with only a partial stroke to thus present an only partially open cross-sectional flow passage area. As a result, the fresh combustion gas flows into the cylinder at a high velocity, generating a vortex in the combustion chamber. Following the subsequent full opening of the cross-sectional flow passage area of the valve, such a vortex improves the mixture formation and the motion of the charge in the cylinder. Since in such a case too, the pressurizing of the intermediate space between the two gas spring pistons may be freely controlled, such an operation may be practiced between wide limits.

According to a further advantageous feature of the invention, the pressure chamber of at least one gas spring is provided with a pressure sensor which is connected with a control device for determining the position of the armature. By setting the system for a predetermined mode of operation such that in the de-energized state of the electromagnets the armature is in a mid position between the two electromagnets, in which case the gas pressures in the closing gas spring and in the opening gas spring are also identical (provided that the chamber volumes and the piston faces are identical), an operation is obtained where an armature motion against the resetting force of one gas spring causes an increase of the gas pressure therein and a decrease of the gas pressure in the opposite gas spring. The change of the gas pressure is therefore proportional to the position of the armature between the two electromagnets and thus information concerning the position of the armature may be obtained by detecting the pressure change. The signal obtained from the pressure sensor may then be applied to the control device. This is of significance particularly as the armature approaches the capturing electromagnet because in such a case the control device may accordingly control the current supply to the capturing electromagnet.

DESCRIPTION OF THE PREFERRED EMBODIMENTS

Figure 1:
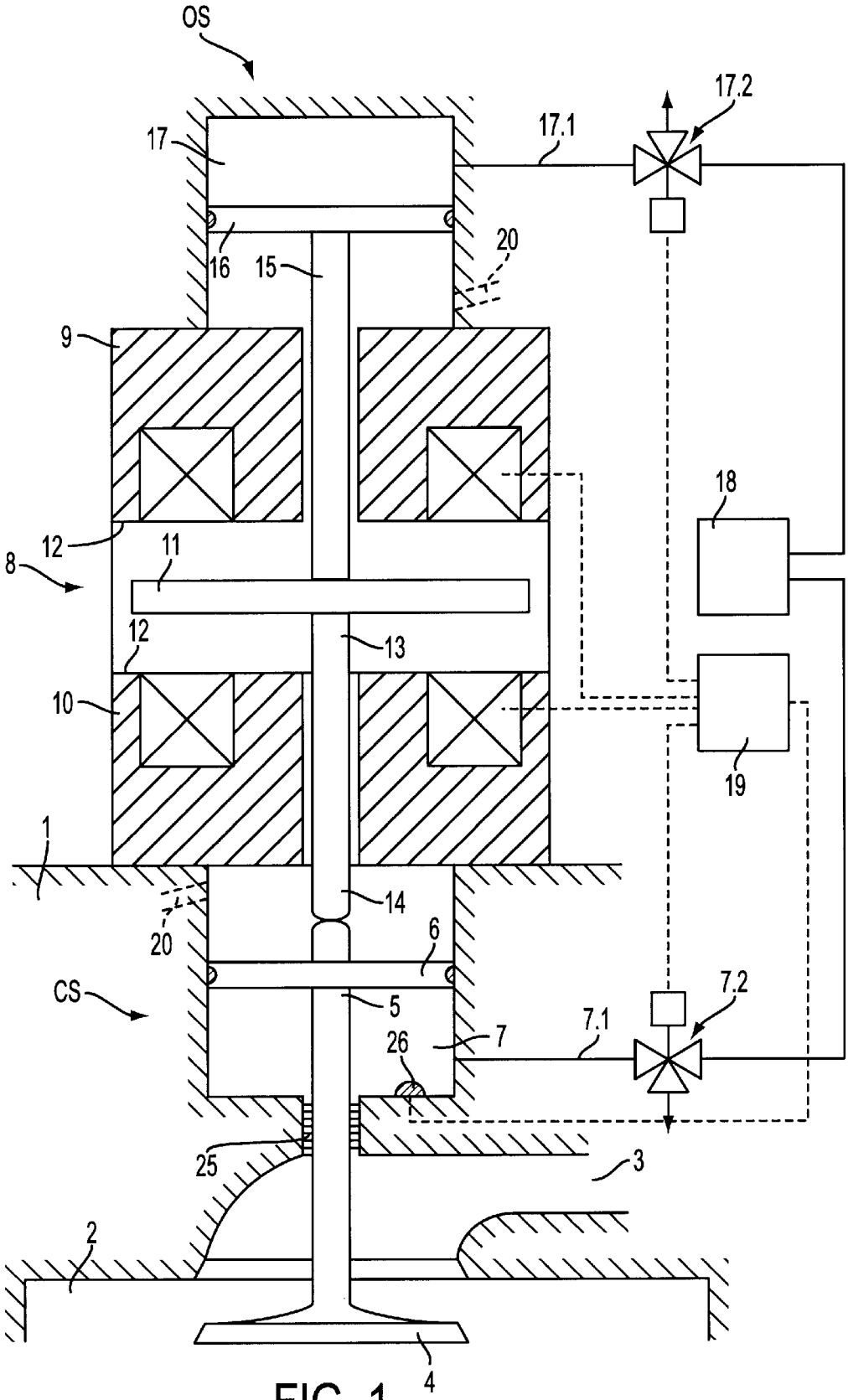
FIG. 1 is a schematic axial sectional view of a preferred embodiment of the invention.

FIG. 1 illustrates one part of a cylinder head 1 of a piston-type internal-combustion engine in the port region of an engine cylinder 2. The port 3 which opens into the cylinder 2 and which may be an intake port or an exhaust port, may be opened or closed by a cylinder valve 4 in accordance with a control based on the operating cycle of the engine. The cylinder valve 4 has a valve stem 5 carrying a piston 6 which is accommodated for axial sliding motion in a cylinder 7 provided in the cylinder head 1.

The cylinder valve 4 is operated by an electromagnetic actuator 8 which is essentially composed of a closing magnet 9 and an opening magnet 10 situated at a distance from the closing magnet 9. Between the two magnets 9 and 10 an armature 11 is guided for a reciprocating motion. In the embodiment illustrated, the armature 11 is situated, in the de-energized state of the electromagnets 9 and 10, midway between the pole faces 12 of the two magnets 9 and 10.

The armature 11 is affixed to a guide rod 13 which, at its free end 14, is connected with the valve stem 5 and which, at its other free end 15 is provided with a piston 16 guided in a cylinder 17. The cylinders 7 and 17 are connected with a pressure supply source 18 by means of respective pressure lines 7.1 and 17.1. In the lines 7.1 and 17.1 respective controllable valves 7.2 and 17.2 (shown as three-way valves) are disposed, so that dependent on the position of the valve 5, the pressure in the cylinders 7 and 17 may be increased or reduced. The setting drives for the valves 7.2 and 17.2 are connected with a control device 19 forming an integral part of the engine control system.

The control device 19 also controls the current supply to the electromagnets 9 and 10 dependent on operational requirements of the engine. The cylinder 7 together with the piston 6 and the cylinder 17 together with the piston 16 each constitute a gas spring which serves in the described embodiment as resetting springs for the electromagnetic system. The piston-and-cylinder unit 6, 7 thus forms a closing gas spring CS and the piston-and-cylinder unit 16, 17 constitutes an opening gas spring OS for the cylinder valve 4. If the two gas springs CS and OS are charged with a predetermined (for example, identical) pressure, the armature 11, in case of a de-energized state of the electromagnets 9 and 10, assumes its illustrated position midway between the pole faces 12 of the electromagnets 9 and 10. As the armature 11, for example, by means of particular starting measures, arrives into engagement with the closing magnet 9 upon energization thereof, the pressure in the opening spring OS accordingly increases. Upon de-energizing the closing magnet 9 the opening spring OS accelerates the armature 11 in the direction of the opening magnet 10 and as the armature 11 passes its mid position, the gas pressure in the closing spring CS increases as the distance between the approaching armature 11 and the pole face 12 of the opening magnet 10 decreases. As the armature 11 traverses its mid position, the opening magnet 11 is energized so that the generated electromagnetic field captures the armature 11 and carries it into engagement with the pole face 12 of the opening magnet 10, whereupon the cylinder valve 4 is held in its open position in accordance with a period of energization determined by the control device 19. Upon closing of the cylinder valve 4, the opening magnet 10 is de-energized and the closing magnet 9 is energized in a reverse sequence. The reciprocating motion of the armature 12 and the cylinder valve 4 resulting from such a current control thereafter progresses in accordance with cycles inputted into the engine control system by the engine rpm. The work chambers of the cylinders 7 and 17 oriented towards the electromagnets 9 and 10 have respective vents 20 to avoid an adverse effect on the motion characteristics of the armature 11 in case an encapsulated magnetic system is used.

Figure 2:
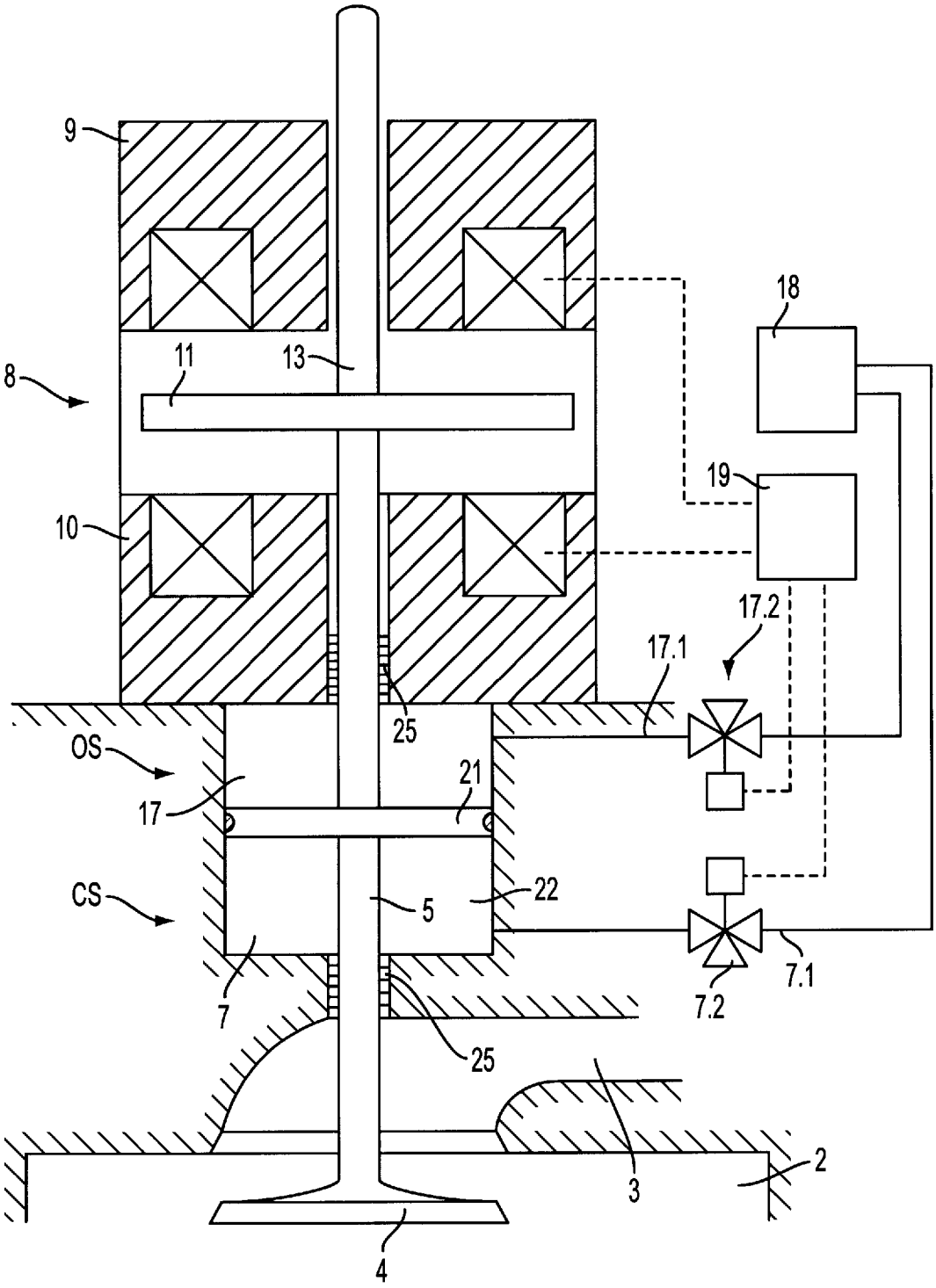
FIG. 2 is a schematic axial sectional view of a further preferred embodiment of the invention.

The embodiment illustrated in FIG. 2 corresponds in its principal construction and mode of operation essentially to the embodiment illustrated in FIG. 1. In the FIG. 2 embodiment, however, the stem 5 of the cylinder valve 4 and the guide rod 13 connected with the armature 11 constitute a one-piece component and further, the opening gas spring OS and the closing gas spring CS are coupled with a common piston 21 which is guided in a common cylinder 22. The electromagnetic actuator 8 seals off the upper opening of the cylinder 22 so that by charging the chambers of the cylinders 7 and 17 with pressure by means of the separate lines 7.1 and 17.1 provided with respective control valves 7.2 and 17.2, the resetting forces required for the back-and-forth motion of the armature 11 may be generated.

Figure 3:
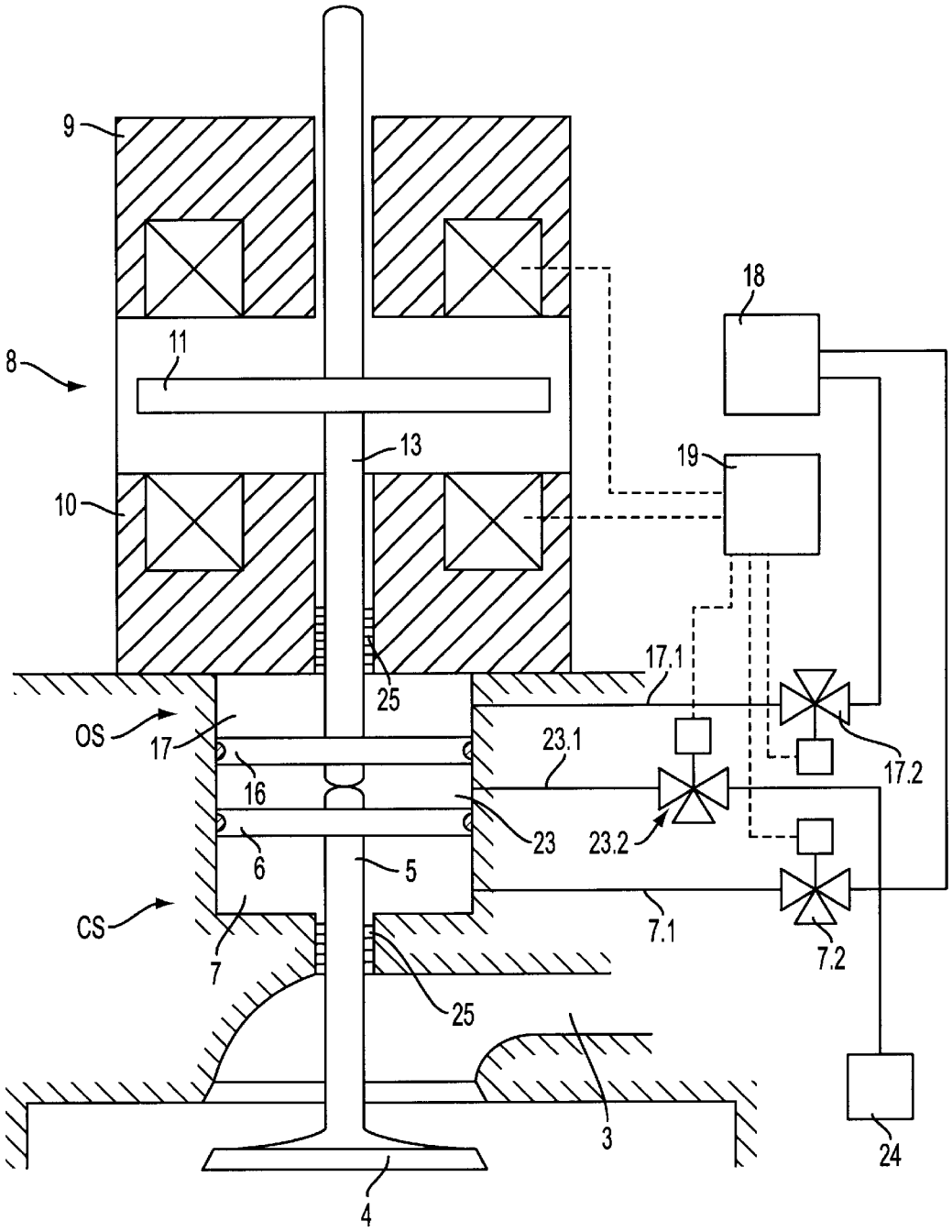
FIG. 3 is a schematic axial sectional view of yet another preferred embodiment of the invention.

The embodiment illustrated in FIG. 3 shows a variant of the FIG. 2 construction. The valve stem 5 of the cylinder valve 4 and the guide rod 13 of the armature 11 are separate as in FIG. 1 and are therefore movable independently from one another. Their free ends projecting into the cylinder 22 are provided with respective pistons 6 and 16 in such a manner that between the pistons 6 and 17 an intermediate space 23 (separate work chamber) is maintained.

The cylinders 7 and 17 are, as in the earlier-described embodiment of FIG. 1, connected with a pressure supply source 18 so that, by virtue of controlling the valves 7.2 and 17.2, a suitable pressure may be adapted in the chambers of the cylinders 7 and 17 to the operational requirements.

The intermediate space 23 has its own pressure line 23.1 which is provided with a controllable valve 23.2 and which leads to a pressure supply source 24. The valve 23.2 is a three-way valve so that by suitably setting the valve 23.2, pressurized medium may be introduced into and removed from the intermediate space 23.

The line 23.1 is so arranged that it opens into the intermediate chamber 23 when the cylinder valve 4 is in its closed position, that is, the armature 11 lies against the closing magnet 9. If, in such a position of the armature 11, the intermediate space 23 is charged with a pressure that is greater than the pressure in the chamber of the cylinder 7 then, corresponding to the duration of such pressurizing, the cylinder valve 4 is opened independently from its actuation by electromagnetic forces generated by the electromagnetic actuator 8. The mass flow of the pressure medium which is preferably also a gas, determines essentially the magnitude of the opening stroke to be effected for the cylinder valve 4. In practice, however, only a small opening stroke is assigned to the cylinder valve 4 as urged by the pressure in the intermediate space 23 in order to provide only a slight valve opening at the beginning of the suction stroke to thus ensure a higher flow velocity of the fresh combustion gas flowing into the combustion chamber of the cylinder. Thereafter, by an energization of the opening magnet 10, the electromagnetic actuator 8 moves the valve 4 into the fully open position, as the armature 11 executes its full stroke toward the electromagnet 10. The control of the valve 23.2 is freely selectable so that an arbitrary adaptation to the operational requirements is possible for the control device 19 forming part of the engine control system.

In the embodiments according to FIGS. 2 and 3, the passage for the guide rod through the electromagnet 10 and the passage for the stem 5 of the cylinder valve 4 have to be provided with a suitable seal.

Reverting to FIG. 1, to determine the position of the armature 11 in relation to the respective pole faces 12 of the electromagnets 9 and 10, at least in one of the pressure chambers, for example, in the cylinder 7, a pressure sensor 26 is disposed whose signal conductor is connected to the control device 19. By monitoring the pressure or its change over time, a prediction concerning the position of the armature may be made as it approaches the pole face 12 of the respective capturing electromagnet. Such a signal may be utilized in the control of the current supply for the capturing electromagnet. It is also feasible to provide a similar pressure sensor in the cylinder 17 as well, so that from the superposition of the two signals (increase of pressure in one cylinder and a corresponding pressure drop in the other cylinder) the reliability of the indication of the armature position may be increased.

It is a further advantage of such pressure sensors that the pressure detected in each instance for the two cylinders 7 and 17 may also be used for controlling the valves 7.2 and 17.2 if, for example, in case of an increasing or decreasing rpm the pressure should be accordingly increased and reduced, respectively.

It will be understood that the above description of the present invention is susceptible to various modifications, changes and adaptations, and the same are intended to be comprehended within the meaning and range of equivalents of the appended claims.

What is claimed is:

1. A combination of a cylinder valve of an internal-combustion engine with an electromagnetic assembly for operating said valve; said assembly comprising (a) an electromagnetic actuator including
  (1) first and second electromagnets supported in a spaced relationship with respect to one another;
  (2) an armature movable between said first and second electromagnets; and
  (3) coupling means for operatively connecting said armature with said valve for moving said valve between open and closed positions by said armature;

(b) a first control device for energizing said electromagnets to cause a motion of said valve by electromagnetic forces generated by said first and second electromagnets;

(c) first and second pressurizable resetting gas springs operatively coupled to said armature to oppose motions thereof caused by said electromagnetic forces generated by said first and second electromagnets, respectively;

(d) a pressure supply means for supplying pressure to said first and second resetting gas springs;

(e) a second control device for controlling the pressure supplied to said first and second resetting gas springs; and (f) a pressure sensor disposed in at least one of said first and second resetting gas springs and connected to said first control device for detecting pressures, representing positions of said armature, in said one resetting gas spring.

2. The combination as defined in claim 1, wherein said first and second resetting gas springs are situated externally of said electromagnetic actuator.

3. The combination as defined in claim 1, wherein one of said first and second resetting gas springs is a closing spring urging said valve into said closed position and the other of said first and second resetting gas springs is an opening spring urging said valve into said open position; said closing spring being connected with said valve and said opening spring being connected with said armature.

4. The combination as defined in claim 3, wherein said armature and said opening spring are movable separately from said valve and said closing spring.

* * * * *